US010032595B2

(12) United States Patent
Lamaitre

(10) Patent No.: US 10,032,595 B2
(45) Date of Patent: Jul. 24, 2018

(54) ROBUST ELECTRODE WITH SEPTUM ROD FOR BIASED X-RAY TUBE CATHODE

(71) Applicant: General Electric Company, Schenectady, NY (US)

(72) Inventor: Sergio Lamaitre, Milwaukee, WI (US)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 104 days.

(21) Appl. No.: 15/056,479

(22) Filed: Feb. 29, 2016

(65) Prior Publication Data

US 2017/0250051 A1 Aug. 31, 2017

(51) Int. Cl.

| | |
|---|---|
| ***H01J 35/14*** | (2006.01) |
| ***H01J 3/18*** | (2006.01) |
| ***H01J 35/06*** | (2006.01) |
| ***H01J 3/02*** | (2006.01) |

(52) U.S. Cl.

CPC ..... *H01J 3/18* (2013.01); *H01J 3/027* (2013.01); *H01J 35/06* (2013.01)

(58) Field of Classification Search

CPC ..... H01J 35/06; H01J 2235/06; H01J 35/14; H01J 3/18; A61B 6/40; A61B 6/461; A61B 6/54

USPC ..... 378/119–138

See application file for complete search history.

(56) References Cited

U.S. PATENT DOCUMENTS

| | | | | |
|---|---|---|---|---|
| 3,916,202 | A * | 10/1975 | Heiting | H01J 35/045 378/113 |
| 7,795,792 | B2 | 9/2010 | Arnold et al. | |
| 8,831,178 | B2 | 9/2014 | Lemaitre | |
| 2002/0126798 | A1* | 9/2002 | Harris | H01J 35/06 378/136 |
| 2010/0067663 | A1* | 3/2010 | Freudenberger | H01J 1/16 378/136 |

* cited by examiner

*Primary Examiner* — Courtney Thomas

(57) ABSTRACT

In the present invention, a cathode assembly for an X-ray tube is provided including a cathode cup, a pair of emitters disposed within the cup and each configured to emit an electron beam therefrom and an electrode spaced from the pair of emitters and configured to affect the shape and/or intensity of the electron beams emitted by the pair of emitters. The electrode includes a rod extending across a central aperture defined within the electrode that enables the electrode to grid or focus the electron beam or beams emitted from the emitters using a bias voltage between +10 kV and −10 kV.

21 Claims, 5 Drawing Sheets

ROBUST ELECTRODE WITH SEPTUM ROD FOR BIASED X-RAY TUBE CATHODE

BACKGROUND OF INVENTION

The subject matter disclosed herein relates to X-ray tubes, and in particular, to X-ray cathode systems and X-ray cathodes.

Presently available medical X-ray tubes typically include a cathode assembly having an emitter and a cup. The cathode assembly is oriented to face an X-ray tube anode, or target, which is typically a planar metal or composite structure. The space within the X-ray tube between the cathode and anode is evacuated.

X-ray tubes typically include an electron source, such as a cathode, that releases electrons at high acceleration. Some of the released electrons may impact a target anode. The collision of the electrons with the target anode produces X-rays, which may be used in a variety of medical devices such as computed tomography (CT) imaging systems, X-ray scanners, and so forth. In thermionic cathode systems, a filament is included that may be induced to release electrons through the thermionic effect, i.e. in response to being heated. However, the distance between the cathode and the anode must be kept short so as to allow for proper electron bombardment. Further, thermionic X-ray cathodes typically emit electrons throughout the entirety of the surface of the filament. Accordingly, it is very difficult to focus all electrons into a small focal spot.

X-ray systems typically include an x-ray tube, a detector, and a support structure for the x-ray tube and the detector. In operation, an imaging table, on which an object is positioned, is located between the x-ray tube and the detector. The x-ray tube typically emits radiation, such as x-rays, toward the object. The radiation typically passes through the object on the imaging table and impinges on the detector. As radiation passes through the object, internal structures of the object cause spatial variances in the radiation received at the detector. The data acquisition system then reads the signals received in the detector, and the system then translates the radiation variances into an image, which may be used to evaluate the internal structure of the object. One skilled in the art will recognize that the object may include, but is not limited to, a patient in a medical imaging procedure and an inanimate object as in, for instance, a package in an x-ray scanner or computed tomography (CT) package scanner.

X-ray tubes typically include a rotating anode structure for the purpose of distributing the heat generated at a focal spot. An x-ray tube cathode provides an electron beam from an emitter that is accelerated using a high voltage applied across a cathode-to-anode vacuum gap to produce x-rays upon impact with the anode. The area where the electron beam impacts the anode is often referred to as the focal spot. Typically, the cathode includes one or more cylindrically wound filaments positioned within a cup for emitting electrons as a beam to create a high-power large focal spot or a high-resolution small focal spot, as examples. Imaging applications may be designed that include selecting either a small or a large focal spot having a particular shape, depending on the application.

Conventional cylindrically wound filaments, however, emit electrons in a complex pattern that is highly dependent on the circumferential position from which they emit toward the anode. Due to the complex electron emission pattern from a cylindrical filament, focal spots resulting therefrom can have non-uniform profiles that are highly sensitive to the placement of the filament within the cup. As such, cylindrically wound filament-based cathodes are manufactured having their filament positioned with very tight tolerances in order to meet the exacting focal spot requirements in an x-ray tube. In particular, X-ray tubes including coiled or cylindrically wound filament-based cathode designs require that the cathode be seated deeper within the cup in order to provide sufficient distance between the cathode and the anode for proper focusing of the more scattered electron emission from the coiled electrode.

In an attempt to generate a more uniform profile of electrons emitted from the cathode towards the anode to obtain a more uniform focal spot, wound filament-based cathodes having an approximately flat emitter surface have been developed. Typically a flat emitter may take the form of a D-shaped filament that is a wound filament having the flat of the "D" facing toward the anode, such as disclosed in U.S. Pat. No. 7,795,792 B2, incorporated herein by reference in its entirety. Such a design emits a more uniform pattern of electrons and emits far fewer electrons from the rounded surface of the filament that is facing away from the anode (that is, facing toward the cup). D-shaped filaments, however, are expensive to produce (they are typically formed about a D-shaped mandrel) and typically require very tight manufacturing and positioning tolerances with separately biased focus electrodes in order to meet focal spot requirements.

As an alternative to the coiled emitters, a flat surface emitter (or a 'flat emitter') may be positioned within the cathode cup with the flat surface positioned orthogonal to the anode, such as that disclosed in U.S. Pat. No. 8,831,178, incorporated herein by reference in its entirety. In the '178 patent a flat emitter with a rectangular emission area is formed with a very thin material having electrodes attached thereto, which can be significantly less costly to manufacture compared to conventionally wound (cylindrical or non-cylindrical) filaments and may have a relaxed placement tolerance when compared to a conventionally wound filament. In particular, cathodes with flat emitters are capable of directing the electrons in a more parallel direction from the emitter, and thus can be seated more shallowly within the cup.

X-ray tubes having cathodes with flat emitters may additionally include a grid electrode. The electron emission originating from the surface of a thermoionic electron emitter, the flat emitter, strongly depends on the "pulling" electric field generated by the X-ray tube's anode. For enabling fast on/off switching of the tube, it is known from the relevant prior art that X-ray tubes of the rotary-anode type may be equipped with a grid electrode placed in front of the electron emitter. To shut off the electron beam completely, a bias voltage is applied to the grid electrode which generates a repelling field and is usually given by the absolute value of the potential difference between the electron emitter and the grid electrode. The resulting electric field at the emitter surface is the sum of the grid and the anode generated field. If the total field is repelling on all locations on the electron emitter, electron emission is completely cut off.

However, X-ray tubes using a flat filament/emitter require higher negative voltages to be applied to the grid electrode compared to cathodes that utilize coiled filaments due to the geometry or shape of the flat emitter. Thus, if an X-ray tube includes a cathode with a flat emitter and both grid and focusing electrodes, large bias voltages for the grid electrode are required in excess of the typical +/−10 kV with respect to the cathode potential in order to accurately focus the electron beam from the emitter on the desired target size.

Such large voltages present many difficulties for the construction of X-ray tubes, including reliability and construction cost challenges regarding the requirements for the insulation located both inside the cathode assembly and on the supply cable.

Nevertheless, flat emitters are desirable for use in X-ray tube cathodes primarily for the longer filament life provided by the flat emitter geometry. However, in order to limit the required grid voltage to within typical ranges, the aspect ratio of the filament has to be increased. In so doing, the bias voltages for the focusing electrode(s) need to become positive to reduce the size of the electrode beam from the emitter to obtain useful focal spot sizes. However, cathodes positive voltages draw electrons and make it impossible to focus the electron beam and/or obtain a stable bias voltage.

Hence it is desirable to provide an X-ray tube with a flat filament emitter/cathode which can effectively employ focus and grid electrodes within a typical bias voltage maximum of +/−10 kV with respect to cathode while also providing a large emission area.

BRIEF DESCRIPTION OF THE INVENTION

There is a need or desire for a system and method to emit an electron beam from an X-ray tube using higher emission currents without degrading the useful life of the X-ray tube. The above-mentioned drawbacks and needs are addressed by the embodiments described herein in the following description. In the present invention, for maximum emission a cathode is formed with one or more flat emitters that are spaced from one another within a cathode cup. The cup further includes width and length focus electrodes spaced from the emitter(s) that act on the electron beams from the emitter(s) to assist in directing the emission of electrons towards the desired focal point. The width electrode assembly, or alternatively the length electrode assembly, is between the emitting surface and target or anode and includes a septum or rod-like feature positioned above the emitter(s). Bias voltages applied to this width electrode and thus the rod will either grid (negative bias) or focus (positive bias) the electron beam in the width direction. With this construction, the cathode can increase the effective emission area from the emitter(s) in the cathode while reducing the aspect ratio required for the emitter(s). In addition, the cathode with this construction can be operated within the bias voltage maximum of +/−10 kV for the grid and focus electrodes with respect to cathode to achieve large and small focal spots for the electron beam. Further, the rod can optionally be biased separately from the electrodes in order to further shift or move the focal spot for the electron beams from the emitters.

One exemplary embodiment of the invention is a cathode assembly for an X-ray tube, the cathode assembly including a cathode cup, a pair of emitters disposed within the cup and each configured to emit an electron beam therefrom and a first electrode spaced from the pair of emitters and configured to affect the shape and/or intensity of the electron beams emitted by the pair of emitters, the first electrode including a rod extending across a central aperture defined within the first electrode.

Another exemplary embodiment of the invention is a method for affecting the intensity and shape of a focal spot of an electron beam emitted from an X-ray tube, the method including the steps of providing an X-ray tube including a cathode assembly having a cathode cup in which is disposed a pair of emitters for generating a pair of electron beams and a first electrode for gridding and/or focusing the pair of electron beams, the first electrode defining a central aperture with a pair of electrode sections disposed on opposed sides of the central aperture and a rod extending across the central aperture between the electrode sections, and a target for generating X-rays when impinged upon by the electron beams, passing a current through at least one of the pair of emitters to generate an electron beam and biasing the first electrode with a voltage to grid or focus the electron beam as the electron beam passes through the central aperture to one or both sides of the rod.

Another exemplary embodiment of the invention is an electrode for gridding and/or focusing at least one electron beam from an emitter, the electrode including a ring-shaped housing defining a central aperture therein, a pair of electrode sections disposed on the housing on opposed sides of the central aperture and a rod extending across the central aperture between the electrode sections.

In another exemplary embodiment of the invention, a cathode assembly for an X-ray tube includes a cathode cup, a pair of emitters disposed within the cup and each configured to emit an electron beam therefrom and a first electrode spaced from the pair of emitters and configured to affect the shape and/or intensity of the electron beams emitted by the pair of emitters, the first electrode including opposed electrodes and a rod extending across a central aperture defined within the first electrode where the rod is further insulated from the electrodes on opposed sides. Bias voltages applied to the rod are within +/−2 kV from the electrodes on opposed sides and thus the rod is capable of further moving the focal spot position.

It should be understood that the brief description above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure

BRIEF DESCRIPTION OF THE DRAWINGS

The drawings illustrate the best mode presently contemplated of carrying out the disclosure. In the drawings.

DETAILED DESCRIPTION OF THE DRAWINGS

In the following detailed description, reference is made to the accompanying drawings that form a part hereof, and in which is shown by way of illustration specific embodiments, which may be practiced. These embodiments are described in sufficient detail to enable those skilled in the art to practice the embodiments, and it is to be understood that other embodiments may be utilized and that logical, mechanical, electrical and other changes may be made without departing from the scope of the embodiments. The following detailed description is, therefore, not to be taken in a limiting sense.

Exemplary embodiments of the invention relate to an X-ray tube including a cathode assembly with a robust cathode including a flat emitter to accommodate larger emission currents. The cathode also includes a grid and focusing electrode(s) that includes a central rod or septum extending across the electrode to affect the electron beam emitted from the emitters and provide the desired focal spot for the electron beam.

Figure 1:
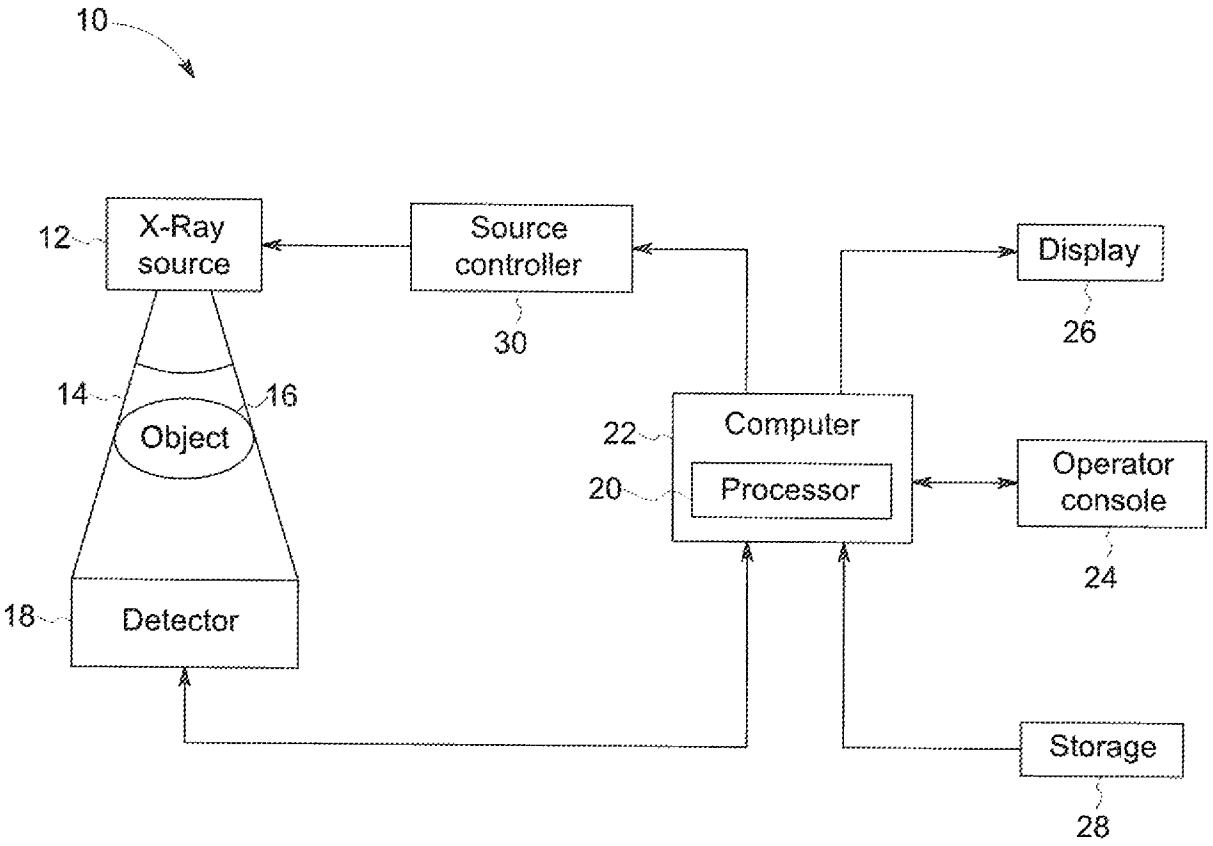
FIG. 1 is a block diagram of an imaging system according to an exemplary embodiment of the invention.

FIG. 1 is a block diagram of an embodiment of an imaging system 10 designed both to acquire original image data and to process the image data for display and/or analysis in accordance with embodiments of the invention. It will be appreciated by those skilled in the art that embodiments of the invention are applicable to numerous medical imaging systems implementing an x-ray tube, such as x-ray or mammography systems. Other imaging systems such as computed tomography (CT) systems and digital radiography (RAD) systems, which acquire image three dimensional data for a volume, also benefit from embodiments of the invention. The following discussion of x-ray system 10 is merely an example of one such implementation and is not intended to be limiting in terms of modality.

As shown in FIG. 1, x-ray system 10 includes an x-ray source 12 configured to project a beam of x-rays 14 through an object 16. Object 16 may include a human subject, pieces of baggage, or other objects desired to be scanned. X-ray source 12 may be a conventional x-ray tube producing x-rays having a spectrum of energies that range, typically, from 30 keV to 200 keV. The x-rays 14 pass through object 16 and, after being attenuated by the object, impinge upon a detector 18. Each detector in detector 18 produces an analog electrical signal that represents the intensity of an impinging x-ray beam, and hence the attenuated beam, as it passes through the object 16. In one embodiment, detector 18 is a scintillation based detector, however, it is also envisioned that direct-conversion type detectors (e.g., CZT detectors, etc.) may also be implemented.

A processor 20 receives the signals from the detector 18 and generates an image corresponding to the object 16 being scanned. A computer 22 communicates with processor 20 to enable an operator, using operator console 24, to control the scanning parameters and to view the generated image. That is, operator console 24 includes some form of operator interface, such as a keyboard, mouse, voice activated controller, or any other suitable input apparatus that allows an operator to control the x-ray system 10 and view the reconstructed image or other data from computer 22 on a display unit 26. Additionally, console 24 allows an operator to store the generated image in a storage device 28 which may include hard drives, flash memory, compact discs, etc. The operator may also use console 24 to provide commands and instructions to computer 22 for controlling a source controller 30 that provides power and timing signals to x-ray source 12.

Figure 2:
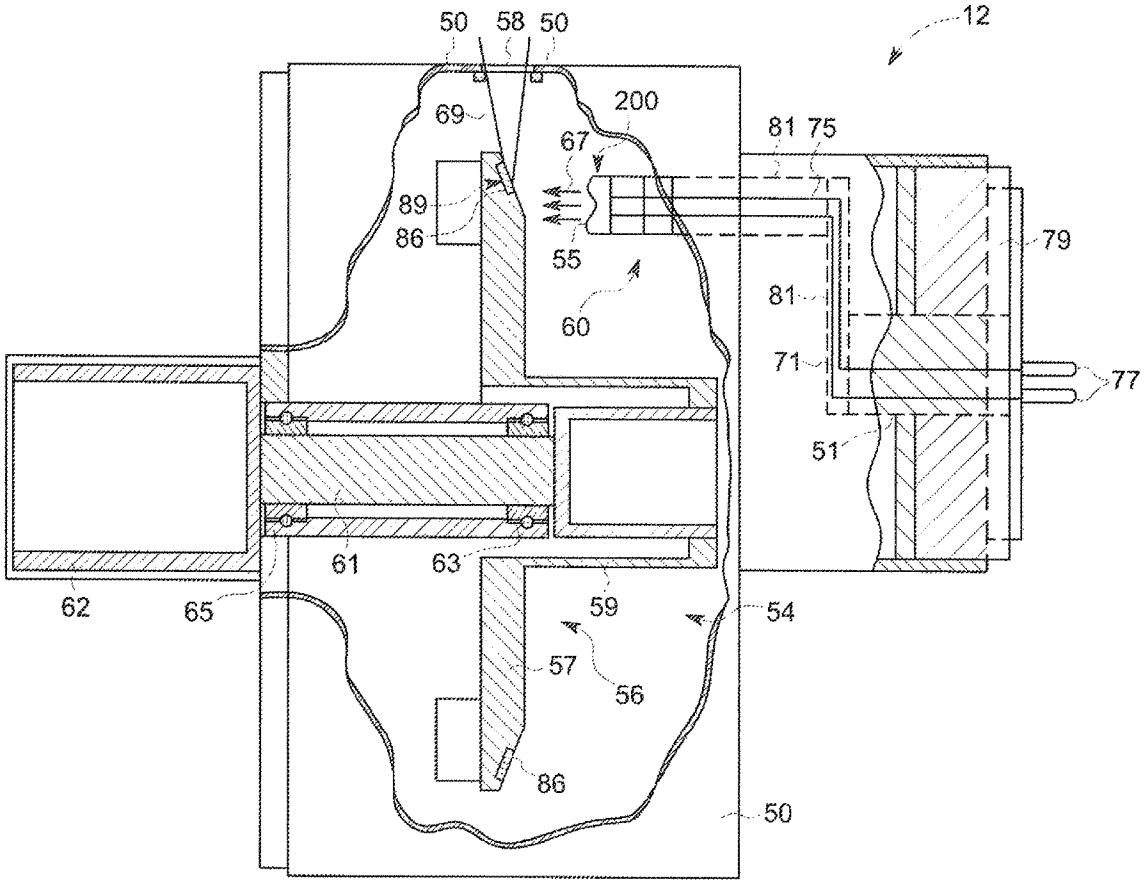
FIG. 2 is a cross-sectional view of an x-ray tube/source according to an exemplary embodiment of the invention.

FIG. 2 illustrates a cross-sectional view of an x-ray tube 12 incorporating embodiments of the invention. X-ray tube 12 includes a frame 50 that encloses a vacuum region 54, and an anode 56 and a cathode assembly 60 are positioned therein. Anode 56 includes a target 57 having a target track 86, and a target hub 59 attached thereto. Terms "anode" and "target" are to be distinguished from one another, where target typically includes a location, such as a focal spot, wherein electrons impact a refractory metal with high energy in order to generate x-rays, and the term anode typically refers to an aspect of an electrical circuit which may cause acceleration of electrons theretoward. Target 56 is attached to a shaft 61 supported by a front bearing 63 and a rear bearing 65. Shaft 61 is attached to a rotor 62. Cathode assembly 60 includes a cathode cup 200 and a flat emitter or filament 55 formed of any suitable emissive material and coupled to a current supply lead 71 and a current return 75 that each pass through a center post 51. In operation, electrical current is carried to flat emitter 55 via the current supply lead 71 and from flat emitter 55 via the current return 75 which are electrically connected to source controller 30 and controlled by computer 22 of system 10 in FIG. 2.

Feedthrus 77 pass through an insulator 79/202 and are electrically connected to electrical leads 71 and 75. X-ray tube 12 includes a window 58 typically made of a low atomic number metal, such as beryllium, to allow passage of x-rays therethrough with minimum attenuation. Cathode assembly 60 includes a support arm 81 that supports cathode cup 200, flat emitter 55, as well as other components thereof. Support arm 81 also provides a passage for leads 71 and 75. Cathode assembly 60 may have focus pads (not shown) that are either attached to cathode cup 200 or machined into cathode cup 200. The cathode assembly 60 includes width and length electrodes 300, 400 (FIGS. 3-4) arranged around the emitter 55 on the cup 200 and can be electrically isolated and operated to provide a focusing field around the emitter 55 to focus the beams of electrons 67 from the emitter 55 in a range from small to large focal spots.

In operation, target 56 is spun via a stator (not shown) external to rotor 62. An electric current is applied to flat emitter 55 via feedthrus 77 to heat emitter 55 and emit electrons 67 therefrom. A high-voltage electric potential is applied between anode 56 and cathode 60, and the difference therebetween accelerates the emitted electrons 67 from cathode 60 to anode 56. Electrons 67 impinge target 57 at target track 86 and x-rays 69 emit therefrom at a focal spot 89 and pass through window 58.

Figure 3:
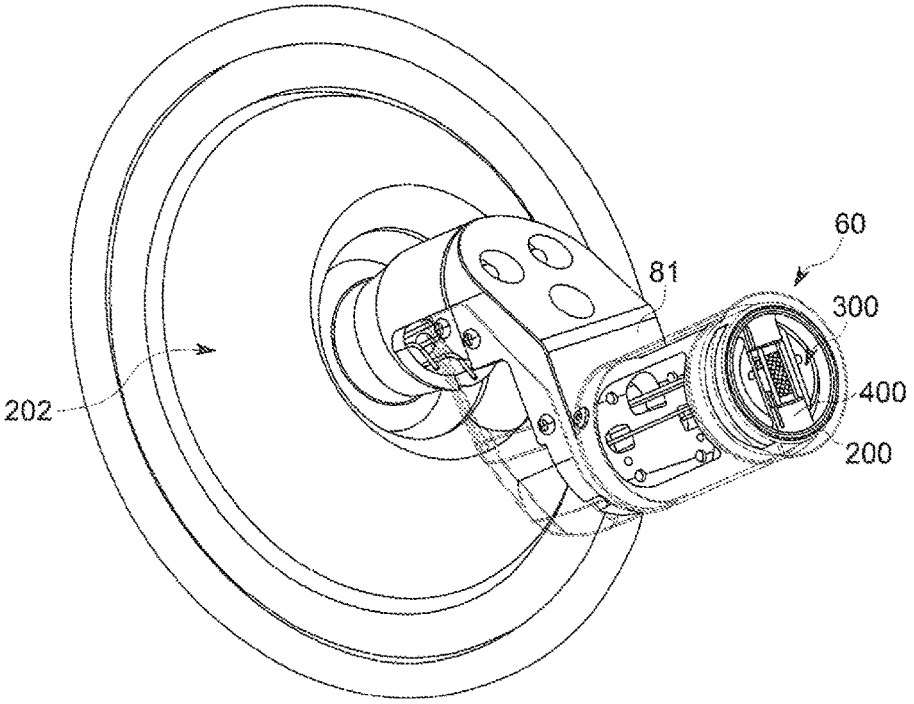
FIG. 3 is an isometric view of a cathode assembly according to an exemplary embodiment of the invention.
Figure 4:
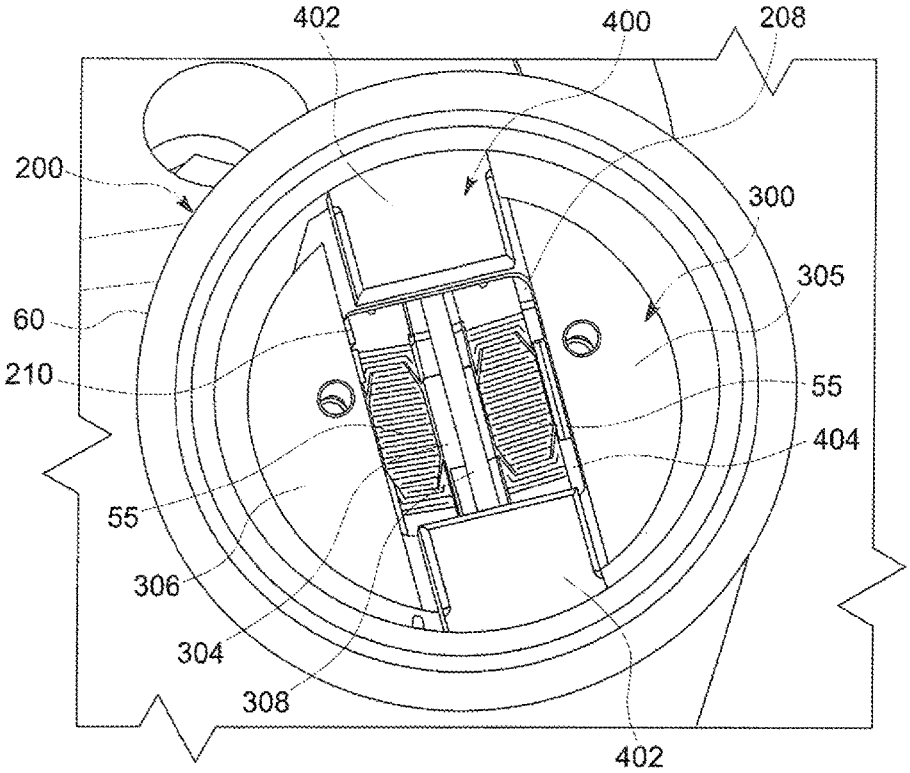
FIG. 4 is an isometric view of a cathode according to an exemplary embodiment of the invention used in the cathode assembly of FIG. 3.
Figure 5:
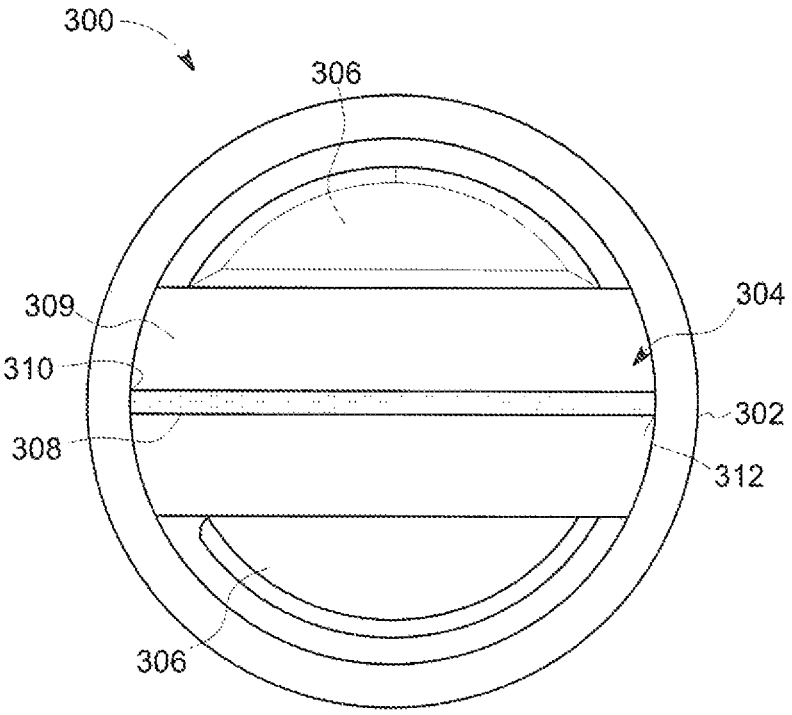
FIG. 5 is a front plan view of a width electrode used in the cathode of FIG. 4 according to an exemplary embodiment of the invention.

Referring now to FIGS. 3-5, the cathode assembly 60 constructed to one exemplary embodiment of the present invention is illustrated therein. Cathode assembly 60 includes cathode cup 200 formed from a suitable material in a suitable process and connected to cathode support arm 81 which is mounted to a high voltage insulator 202. The cathode assembly 60 also includes a width electrode 300 and a length electrode 400 affixed to the cathode cup 200.

The cup 200 includes a pair of flat emitters 55 spaced from one another on the cup 200. The flat emitters 55 can be formed in any suitable manner and of any suitable material, such as that disclosed in co-pending and co-owned U.S. Non-Provisional patent application Ser. No. 14/586,066, entitled *Low Aberration, High Intensity Electron Beam For X-Ray* Tubes, filed on Dec. 30, 2014, the entirety of which is expressly incorporated herein by reference for all purposes. The pair of emitters 55 in one exemplary embodiment divide the total emission area for the emitters 55 lengthwise into two sections thereby providing a larger effective emission area for the cathode assembly 60 with smaller individual aspect ratios for each of the emitters 55 that are better suited to focus narrow focal spot widths.

The emitters 55 are each positioned on and electrically coupled to the cup 200 to be at the same potential as the cup or cathode 200 via respective first and second attachment surfaces 208,210 on the cup 200 which are electrically insulated from each other (not shown) such that no positive voltages are present around the emitters 55 as is the case in conventional cathode designs. Flat emitters 55 typically range in thickness from 200 to 500 microns but are not limited thereto. In a preferred embodiment the thickness of the emitters 55 is 300 microns or less, however one skilled in the art will recognize that the thickness can be selected as desired depending upon the particular application. Further, the sizes and/or shapes of the emitters 55 can be the same or different from one another in order to provide different focusing attributes, i.e., to obtain very large and very small focal spots, to the cathode assembly 60 based on the sizes and/or shapes of the emitters 55. In addition, the emitters 55 can be selectively operated together or separately from one another in order to achieve the desired focal spot on the target 56.

The first and second attachment surfaces 208,210 can be formed to be normal or perpendicular to the direction cathode or at an angle with respect thereto which typically ranges from 5 to 25 degrees in order to place the emitters 55 at an angle with respect to one another that causes the electrons emitted from the emitters 55 to converge at a specified distance from the surface of the emitters 55, which can be designed to be a specified distance from the emitters 55 based on the angles at which the emitters 55 are positioned. Due to the improved focusing, focal spot sizes from small to large focal spots can be obtained by adjusting the heights and/or bias voltages of one or more of the width and length electrodes 300 accordingly. To obtain focal spot sizes relevant for medical imaging, in one exemplary embodiment of the invention, the width of the emitters 55 is typically within 2-6 mm and the length is typically within 6-15 mm. The surfaces of the width electrode 300 and/or length electrode 400 are typically positioned on the cathode cup 200 3-8 mm above the surface of the emission area of the emitter 55 such that the width electrode 300 and length electrode 400 can be biased to predetermined positive or negative voltages relative to the emitter 55 to control the size of the focal spot and/or to cut off the electron beam, such as by biasing the width electrode 300 and/or length electrode 400 to predetermined negative voltages relative to the emitters 55 to cut off the electron beam.

Figure 6:
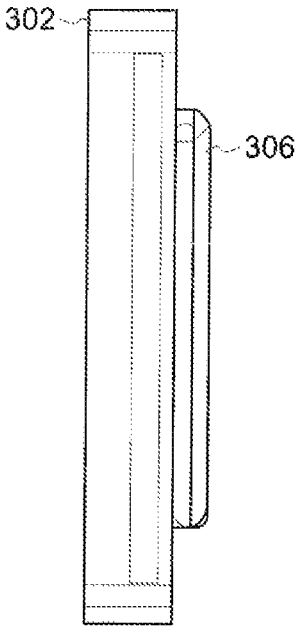
FIG. 6 is a side plan view of the width electrode of FIG. 5.
Figure 7:
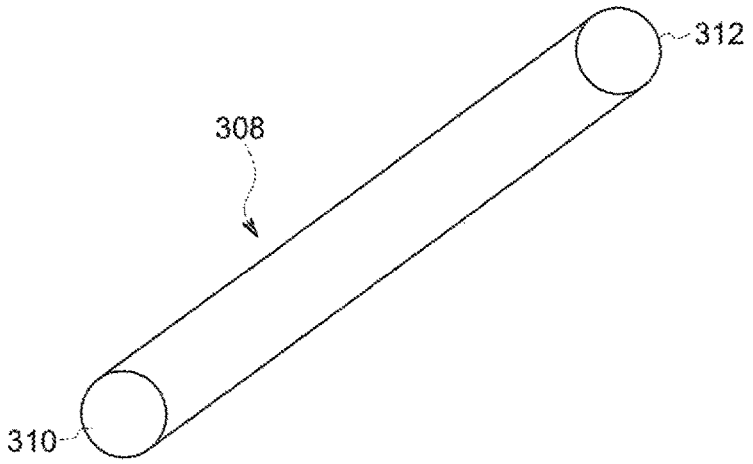
FIG. 7 is an isometric view of one exemplary embodiment of a septum rod used with the width electrode of FIG. 5.

In the exemplary embodiment of FIGS. 4-6, above the flat emitters 55 the cathode assembly 60 includes the width electrode 300. The width electrode 300 is electrically isolated from the emitters 55 such that a biasing voltage applied to the width electrode 300 can be used to affect the electron beam from the emitters 55 in the width direction. The bias voltage applied to the width electrode 300 is within the normal operating ranges of +/−10 kV and can be positive to focus the electron beam, or negative to grid the electron beam from the emitters 55.

Figure 8:
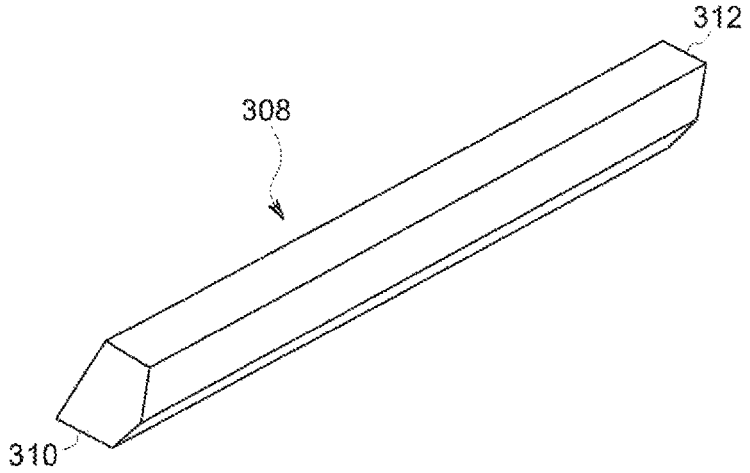
FIG. 8 is an isometric view of another exemplary embodiment of a septum rod used with the width electrode of FIG. 5.

Referring to the exemplary embodiment of the width electrode 300 illustrated in FIGS. 5 and 6, the width electrode 300 is formed with a circular ring-shaped housing 302 that defines a central aperture 304 therein and is attached to but electrically isolated from the cathode assembly 60 to position the width electrode 300 on the cathode assembly 60. A pair of electrode sections 306 are disposed on opposed sides of the housing 302 and extend inwardly towards one another across the central aperture 304. Disposed on the width electrode 300 between the electrode sections 306 is a septum or rod 308 that bisects the portion 309 of the central aperture 304 left uncovered by the electrode sections 306. The rod 308 can be formed integrally with the width electrode 300 in a suitable machining or milling process, using electrical discharge machining, for example, allowing arbitrary cross sectional shapes, such as that shown in FIG. 9, that can provide focusing control of the electron beam. Alternatively, the rod 308 can be formed from of a suitable material separately from and subsequently attached to the housing 302. In one exemplary embodiment, the rod 308 is formed with a diameter of 1-2 mm and a length of 20-30 mm, with the rod 308 affixed to the housing 302 in a position between and above the two emitters 55. The rod 308 can be formed of a suitable metal to be cylindrical in shape, as shown in FIG. 8, and can be attached in the desired location on the housing 302 by welding the rod 308 to the housing 302 at one end 310. The opposite end 312 is left unattached in order to allow for thermal growth or expansion of the rod 308 with respect to the housing 302.

With this configuration for the rod 308, the bias voltage applied to the width electrode 300 is conducted across the electrode sections 306 and the rod 308 to allow the voltage to affect the electron beams from one or both of the emitters 55 that pass through the bisected portions of the central aperture 304 to either side of the rod 308. In the position between and above the emitters 55, no part of the electron beams interfere with the width electrode 300, e.g., the rod 308, during normal operation of the tube 12, as the beams are directed by the emitters 55 through the portions of the central aperture 302 disposed on either side of the rod 308.

Figure 9:
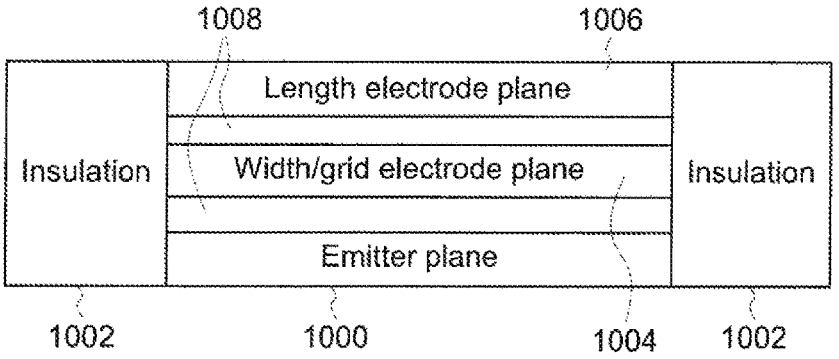
FIG. 9 is a schematic view of an exemplary embodiment of the cathode of FIG. 4.

As shown in FIGS. 3, 4 and 9, an additional length electrode 400 can be positioned above and over the emitters 55 and spaced from the width electrode 300 to affect the electron beams from the emitters 55 in the length direction. The length electrode 400 can be formed of a known material and in a known manner to include a pair of electrode portions 402 at opposed end of the length electrode 400 and disposed between and/or perpendicular to the electrode sections 306 on the width electrode 300 to affect the electrons beams in the length direction as they pass through a central opening 404 defined in length electrode 400 between the electrode sections 402. With the presence and positioning of the width electrode 300, the length electrode 400 is not needed for gridding the electron beams. As such, positive and negative bias voltages in the range of +/−10 kV can be applied to the length electrode 400 in a known manner to maximize the focal spot range as desired. Also, no part of the electron beam will interfere with the length bias electrode during normal operation of the cathode assembly 60.

Looking now at FIG. 9, the cathode cup 200 is schematically illustrated where the emitters 55 are disposed in an emitter plane 1000 with the emitters 55 connected to insulation 1002 in a known manner to electrically isolate the emitters 55. The insulation can be spaced radially away from heat source, i.e., the emitters 55, to minimize any thermal degradation of the insulation 1002. The width electrode 300 and rod 308 are disposed in a width plane 1004 spaced from the emitter plane 1000 and connected to the insulation 1002, while the length electrode 400 is disposed in a length plane 1006 spaced from the width plane 1004 opposite the emitter plane 1000 and also connected to the insulation 1002 that can be designed to satisfy the thermo-structural requirements for the cathode assembly 60 without limiting optics design. In addition to the electrical isolation provided by the insulation 1002, the spaces between the various electrode planes 1000, 1004 and 1006 are formed as vacuum regions 1008 to further isolate the electrode planes 1000, 1004 and 1006 from one another.

In addition, in another exemplary embodiment, the rod 308 can be optionally isolated from and biased separately from the width electrode 300 and the length electrode 400, thereby further enhancing the ability of the cathode assembly 60 to shift the position of the focal spot 89. The bias voltages applied to the rod 308 are between +10 kV to −10 kV and are within +/−2 kV from the width electrodes 300 on opposite sides of the rod 308 and thus the rod 308 is capable of further moving the position of the focal spot 89 as desired.

The written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A cathode assembly for an X-ray tube, the cathode assembly comprising:

a pair of emitters each configured to emit an electron beam therefrom; and a first electrode spaced from the pair of emitters and configured to affect the shape and/or intensity of the electron beams emitted by the pair of emitters, the first electrode including a rod extending across a central aperture defined within the first electrode, wherein the rod is insulated from the first electrode.

2. The cathode assembly of claim 1 further comprising pair of opposed electrode sections spaced from the rod on opposed sides of the first electrode.

3. The cathode assembly of claim 1, wherein the pair of emitter comprises a pair of flat emitters.

4. The cathode assembly of claim 3, wherein the pair of flat emitters are disposed at an angle with respect to one another.

5. The cathode assembly of claim 1, wherein the rod has a generally circular cross-section.

6. The cathode assembly of claim 1, wherein the rod bisects the central aperture.

7. The cathode assembly of claim 1, wherein the rod is formed separately from the first electrode.

8. The cathode assembly of claim 7, wherein the rod is attached to the first electrode at one end of the rod.

9. The cathode assembly of claim 8, wherein the rod is welded to the first electrode at one end.

10. The cathode assembly of claim 1 further comprising a second electrode disposed adjacent the first electrode opposite the pair of emitters.

11. The cathode assembly of claim 10, wherein the pair of emitters, the first electrode and the second electrode are electrically insulated from one another.

12. The cathode assembly of claim 11, wherein the pair of emitters, the first electrode and the second electrode are each separated by a vacuum.

13. An electrode for gridding and/or focusing at least one electron beam from an emitter, the electrode comprising:

a ring-shaped housing defining a central aperture therein;

a width electrode comprising a pair of electrode sections disposed on the housing on opposed sides of the central aperture between and above the emitter to affect the electron beam in a width direction;

a length electrode comprising a pair of electrode sections spaced from the width electrode and above and over the emitter to affect the electron beam in a length direction;

a rod extending across the central aperture between the electrode sections, wherein the rod is joined to the housing at only one end.

14. The electrode of claim 13, wherein the rod is formed separately from the housing.

15. The electrode of claim 13 wherein the rod has a circular cross-section.

16. The electrode of claim 13 wherein the pair of electrode sections of the length electrode are disposed between the pair of electrode sections of the width electrode.

17. A method for affecting the intensity and shape of a focal spot of an electron beam emitted from an X-ray tube, the method comprising the steps of:

providing an X-ray tube including a cathode assembly comprising a pair of emitters for generating a pair of electron beams, a first electrode for gridding and/or focusing the pair of electron beams, the first electrode defining a central aperture with a pair of electrode sections disposed on opposed sides of the central aperture and a rod extending across the central aperture between the electrode sections, a second electrode comprising a pair of electrode sections between and/or perpendicular to the pair of electrode sections of the first electrode, and a target for generating X-rays when impinged upon by the electron beams;

passing a current through at least one of the pair of emitters to generate an electron beam;

biasing the first electrode with a voltage to grid or focus the electron beam as the electron beam passes through the central aperture to one or both sides of the rod;

biasing the rod with a voltage of between within +/−2 kV from the biasing voltage applied to the first electrode; and biasing the second electrode to focus the electron beam.

18. The method of claim 17, wherein the step of biasing the first electrode comprises biasing the first electrode with a negative voltage to grid the electron beam.

19. The method of claim 17, wherein the step of biasing the first electrode comprises biasing the first electrode with a positive voltage to focus the electron beam.

20. The method of claim 17 wherein the steps of biasing the first electrode and the second electrode comprise biasing the first electrode and second electrode with a voltage of between +10 kV to −10 kV.

21. The method of claim 17, wherein the step of biasing the first electrode comprises biasing the first electrode with a voltage of between +10 kV to −10 kV.

* * * * *